US007677331B2

(12) United States Patent
Lowe et al.

(10) Patent No.: US 7,677,331 B2
(45) Date of Patent: Mar. 16, 2010

(54) AC COILED TUBING RIG WITH AUTOMATED DRILLING SYSTEM AND METHOD OF USING THE SAME

(75) Inventors: Derek Joseph Lowe, Calgary (CN); Cory Jason Ziebart, Calgary (CN); Peter Daniel O'Brien, Calgary (CN)

(73) Assignee: Nabors Canada ULC

( * ) Notice: Subject to any disclaimer, the term of this patent is extended or adjusted under 35 U.S.C. 154(b) by 233 days.

(21) Appl. No.: 11/737,505

(22) Filed: Apr. 19, 2007

(65) Prior Publication Data

US 2007/0246261 A1 Oct. 25, 2007

Related U.S. Application Data

(60) Provisional application No. 60/745,194, filed on Apr. 20, 2006.

(51) Int. Cl.
*E21B 3/06* (2006.01)
*E21B 19/08* (2006.01)

(52) U.S. Cl. ..... 175/27; 166/77.2; 166/77.3

(58) Field of Classification Search ..... 166/77.2, 166/77.3; 175/27, 162, 26; 173/6, 9
See application file for complete search history.

(56) References Cited

U.S. PATENT DOCUMENTS 3,872,932 A * 3/1975 Gosselin ..... 173/1
5,235,259 A 8/1993 Dhindsa et al.
5,755,296 A 5/1998 Richardson et al.
6,024,181 A 2/2000 Richardson et al.
6,029,951 A 2/2000 Guggari
6,321,860 B1 11/2001 Reddoch
6,918,454 B2 7/2005 Prior et al.
6,994,172 B2 2/2006 Ray
7,100,698 B2 9/2006 Kracik et al.
7,114,577 B2 10/2006 Newman
7,188,686 B2 3/2007 Folk et al.
2006/0162962 A1 * 7/2006 Koederitz et al. ..... 175/27
2006/0249719 A1 11/2006 Lesko
2006/0283588 A1 * 12/2006 Wood et al. ..... 166/77.2

OTHER PUBLICATIONS

Charles Townsend's Rig Work Web. Website; www.acrigs.com ; printed Apr. 15, 2007.

* cited by examiner

*Primary Examiner*—Jennifer H Gay
*Assistant Examiner*—Cathleen R Hutchins
(74) *Attorney, Agent, or Firm*—Sean W Goodwin

(57) ABSTRACT

A method of automatic drilling of a well with coil tubing or drill pipe tubing utilizes AC motors coupled to variable frequency drives controlled by a programmable logic controller. For example, a coil tube injector is supported in a mast for injecting coil tube from a reel and into a wellbore for drilling the wellbore. The AC motors for the injector are driven for controlling a rate of injection of coil tube by the injector for maintaining at least one drilling parameter such as weight-on-bit, differential mud pressure or rate of penetration. The AC motor for the reel is also controlled for driving the reel and maintaining a relative rate of coil tube supplied from the reel to the injector. Drawworks and a top drive supported by the draworks can also be equipped with AC motors and variable frequency drives for controlling a drilling rate for maintaining at least one of the drilling parameters.

7 Claims, 3 Drawing Sheets

AC COILED TUBING RIG WITH AUTOMATED DRILLING SYSTEM AND METHOD OF USING THE SAME

FIELD OF THE INVENTION

Embodiments of the invention relate to coiled tubing drilling rigs generally, and in particular relate to an improved rig having AC electric components and an automated drilling system.

SUMMARY OF THE PRESENT INVENTION

Applicant provides an overview of the AC control system that is unique to Applicant's coil tube drilling rig.

Applicant's drilling AC electric drive coil tube rig is a hybrid drilling rig that can be set up to drill with continuous coil or drill with pipe. The methods of drilling utilize AC electric motors driven by variable frequency drives (VFD's) to control the speed and torque of the coil and the top-drive system. The AC drive system is integrated with a programmable logic control (PLC) system that monitors and controls the automated drilling system. A VFD system is integrated into the rig to control the coil tube system, the top-drive system, the drawworks, the mud pump, and the blowdown compressor system. This automated drilling system has been developed and customized to meet applicant's needs for coil tube drilling.

The automated drilling system used on the AC coil rig utilizes closed loop control systems to control drilling with weight-on-bit (WOB), differential pressure (ΔP), and rate-of-penetration (ROP). The automated drilling system allows a driller to input a set of drilling parameters via a touchscreen to optimize drilling and tripping operations.

An integrated control system is used to control several other operational and safety systems during drilling.

BRIEF DESCRIPTION OF THE DRAWING FIGURES

Embodiments of the invention will now be described, by way of example only, with reference to the accompanying drawings, wherein.

Figure 1:
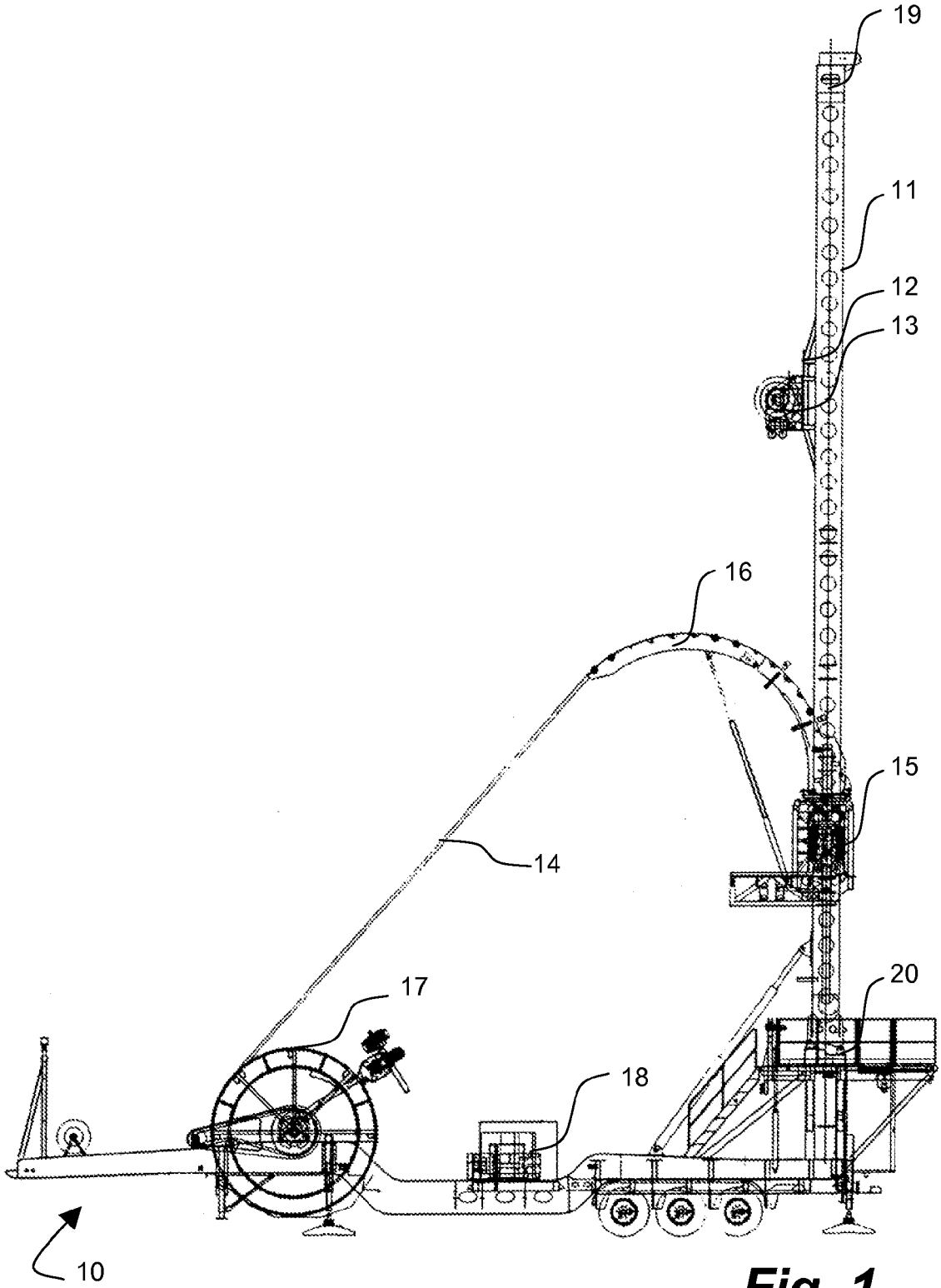
FIG. 1 is a side view of a coiled tubing drill rig according to an embodiment of the present invention.

DESCRIPTION OF PREFERRED EMBODIMENTS a) Overview of Applicant's Coil Tubing Rig As shown in FIG. 1, a hybrid coil tubing rig 10 comprises a mast 11, drawworks 12 and a top-drive 13 for operation with drill string. Further, for operation with coil tubing 14, the rig 10 comprises an injector 15, a gooseneck 16 and a coil tube reel 17. Drilling fluids are provided by mud pumps 18.

Figure 4:
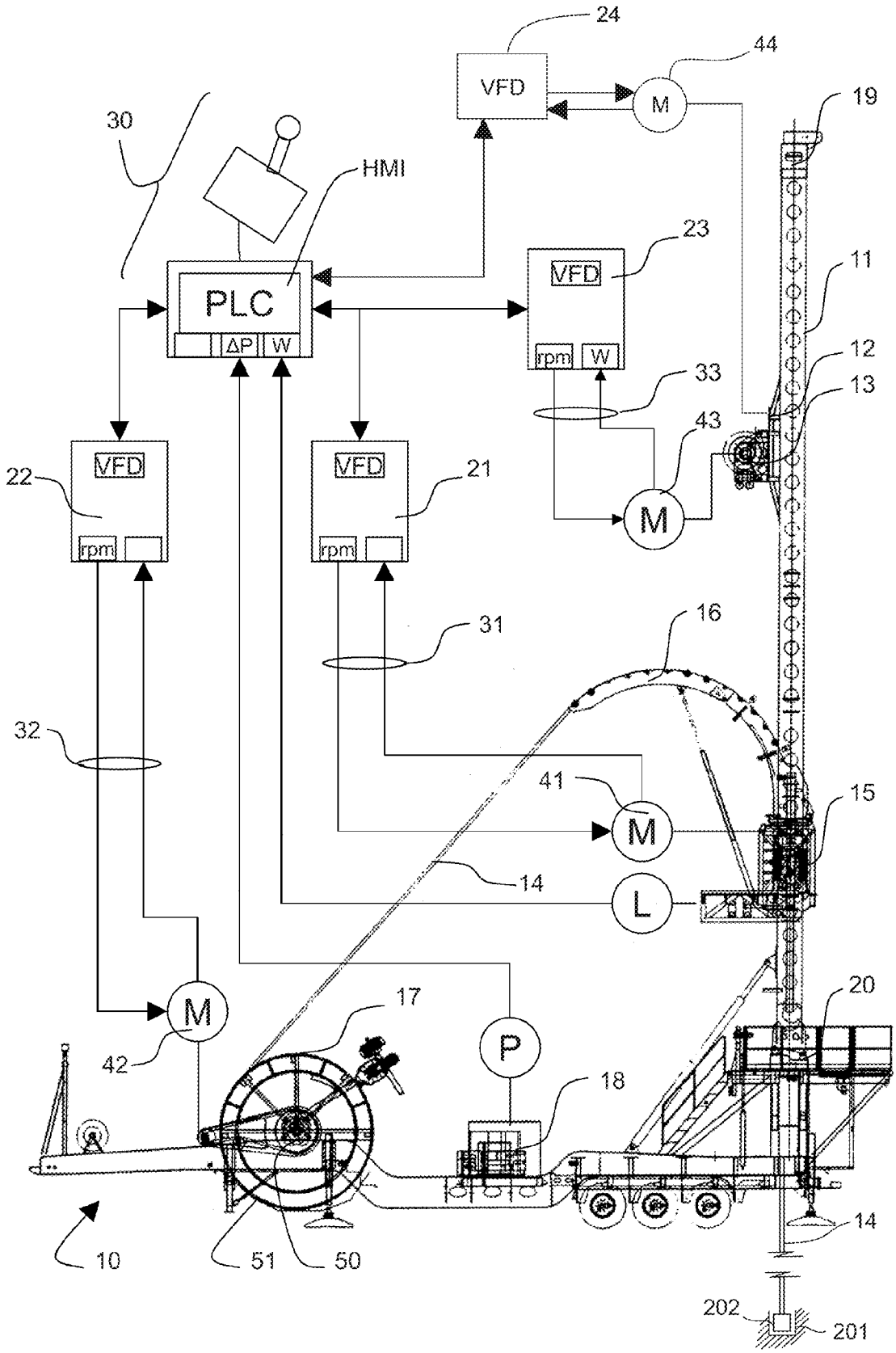
FIG. 4 shows schematics of a control system for the automated drilling system applied to the coil tubing drill rig of FIG. 1.

As shown in FIG. 4, the coil tubing rig 10 of the present invention has three main components that allow for automated drilling; variable frequency drives (VFDs) 21,22,23,24 a control system 30 provided by a programmable logic controller (PLC), and the operator Interface (HMI). The exact nature of the torque control on an AC motor provided by the VFD's 21,22,23,24 allows for automated control of the coil tube rig (CTR) 10 which was previously accomplished via an operator (Driller). The Driller was responsible for constantly monitoring and adjusting hydraulic pressures to hydraulic motors to maintain the desired drilling parameters. As new geological formations were encountered, or the dynamics of the hole changed for various reasons, the Driller would have to adjust hydraulic pressures manually to speed up or slow down the in-hole drilling, trying to maintain a specific weight-on-bit (WOB), differential pressure (ΔP), or rate-of-penetration (ROP). The Applicant's automated CTR 10 is programmed to drill within certain parameters to allow optimal drilling conditions under different circumstances, maintaining WOB, ΔP or ROP depending on what mode the Driller has selected.

The control system 30 for the Applicant's Auto-Drill system is a programmable logic controller (PLC). This controller receives inputs such as the string weight, mud pressure and rate-of-penetration (ROP). Based on these inputs, and operational parameters received via the operator interface (HMI), the PLC computes an output signal 31 to control the injector motors 41 to achieve the operator-desired drilling parameters. During drilling operations, the motors do not act to raise the tubing to achieve the operator-desired drilling parameter. Instead, the PLC directs a VFD which controls the respective motor to change the rate at which the tubing is driven into the hole by the injector motors.

The third component of the Applicant's automated CTR 10 is the operator-interface HMI. The operator panel allows the Driller to choose among the various modes for operation: WOB, ΔP or ROP. The Driller enters in the desired drilling parameters, and the PLC program is used to optimize drilling performance, controlling the coiled tube ROP automatically.

When in weight-on-bit (WOB) or differential pressure mode ΔP, the drill bit 200 is brought off the bottom of the hole 201 (FIG. 4) and the value (either WOB or ΔP) is tared. When in WOB mode, the bit is lowered until it touches the bottom of the hole. When this happens, the string weight decreases and the difference between this and the tared value is attributed to the weight-on-bit. This is all calculated automatically by the PLC. The faster the injector motors 41 move the tubing 14 into the hole, the higher the WOB value. By slowing down the motors 41 and the rate at which the tubing 14 is inserted into the hole, allowing the drill bit to "drill-off", the WOB is decreased.

Similarly, when in differential pressure mode ΔP, the pressure increases as the drill bit is brought near the bottom of the hole. The difference between this increased pressure and the tared value is seen as differential pressure ΔP. The faster the injector motors 41 move the tubing 14 into the hole, the higher the ΔP value. By slowing down the motors 41 and the rate at which the tubing 14 is inserted into the hole, allowing the drill bit to "drill-off", the ΔP is decreased.

In each mode, the difference between the tared value and the measured value is compared to the set value of either the WOB or ΔP entered into the operator-interface (HMI) by the Driller. The difference between the measured value and the set point is termed the "error" signal. It is this error signal that is used by the PLC. The error value is periodically sampled by the PLC during the drilling operation.

The PLC uses a proportional/integral/derivative (PID) algorithm to calculate an output signal to the VFD. The VFD produces an alternating current frequency that is delivered to the injector motors. The speed at which the motors drive the tubing into the hole is directly proportional to the frequency produced by the VFD. The PLC seeks to attain the operator-desired drilling parameter by controlling the speed at which the motors drive the tubing into the hole.

The PID algorithm used by the PLC controller is:

$$\text{Output}=K_c[(E)+1/T_I\int_o^t(E)dt+T_D(PV)I\,df]+\text{bias}$$

where $T_D$ is the derivative time or rate time df is time of the derivative

PV is the process variable namely weight-on-bit or differential pressure or rate-of-penetration I is alternating current Thus, the output from the PLC controller has three components:

- A proportional component denoted by (E) in the equation—the proportional component produces an output that is directly proportional to the error, i.e., the error times constant.
- An integral component is denoted by the integration of (E)dt from time zero to t (the time the measurement is taken). In practice, the integral component essentially totals the error (E) from time zero to t, multiplies it by constant ($1/T_1$), and multiplies the product by the constant $K_c$.
- A derivative component is not used by the Applicant's PLC program at this time.

Based on this equation, the PLC computes the 'best' speed at which the motors need to run in order to maintain the optimal drilling parameters.

b) Coil Tube System

With reference to FIGS. 1 and 4, the major components of the Coil Tube System include the storage reel 17, the gooseneck 16, and the injector 15. The reel 17 is driven by the second motor 42, a 1-60 hp AC Drive motor, and the injector 15 is driven by the first motor 41, two 125 hp AC Drive motors.

i) Reel

The reel 17, about which the coil string 14 is wrapped, is supported by an axle 50 and electrically rotated around a spool 51 by the 60 hp AC Drive Motor 42. Great care must be taken to ensure the reel 17 is perfectly synchronized with the head of the injector 15 as the coil 14 can be damaged during injection or retraction. A first sensor establishes measurements of rate of infection and a second sensor establishes measurements of the rate of coil tube supplied from the reel. The reel motor 42 has a dual function as it acts as a brake during uncoiling and keeps the coil 14 under constant tension during injection. The reel 17 is not used to power or remove the coil 14. The end portion of the coil string will be attached to a revolving hub which allows fluids to be pumped into the string.

As shown in FIG. 4, the storage reel motor 42 is controlled by a second VFD 22. Torque on motor controls the force on the gooseneck 16 and injector 15. The injector 15 and reel 17 must work together to hold back uncoiling of tubing and prevent excess loads on the gooseneck 16.

ii) Injector

The injector 15 is a most important piece of equipment involved with the CTR 10 and this system. Basically it consists of two opposite sets of parallel chains (not detailed) that grip the coil 14 and inject or retract it from the well. The chains are tensioned by a pair of hydraulic cylinders that act to exert an exact amount of pressure on to the coil 14. If too much pressure is exerted the coil 14 will be crushed and if too little is applied the coil 14 will slip. The chains are driven by the first motor 41, being two 125 hp AC electric motors, in order to provide precise control and exact distances are recorded from these motors 41 in order to find out how much tubing has been injected. The first injector motors 41 are driven by the first VFD 21. The gooseneck (guide arch) 16 will act to support the tubing 14 from its transition from coiled position to the straightened position.

As set forth in FIG. 4, load cells under the injector 15 measure in-hole or out-hole force. Further, encoder feedback on the injector motors 41 provide torque control and rotor position.

c) Top Drive/Drawworks System

The top drive 13 rotates the drill pipe system, and is utilized to make and break connections of a drill string (not shown). The top drive 13 is driven by a third motor 43, being two 125 hp AC electric motors, controlled by the third VFD 33. The AC electric top drive 13 has excellent speed and torque control of the drill pipe for continuous drilling and when making and breaking connections.

The top drive 13 is raised and lowered in the mast by the AC electric drawworks 12. The drawworks 12 is driven by a fourth electric motor 44 , such as a 400 hp AC electric motor, that has full torque capabilities at zero speed using a fourth VFD 24. The drawworks 12 can hold the full load weight of the drill string at zero speed without applying mechanical brakes.

Figure 2:
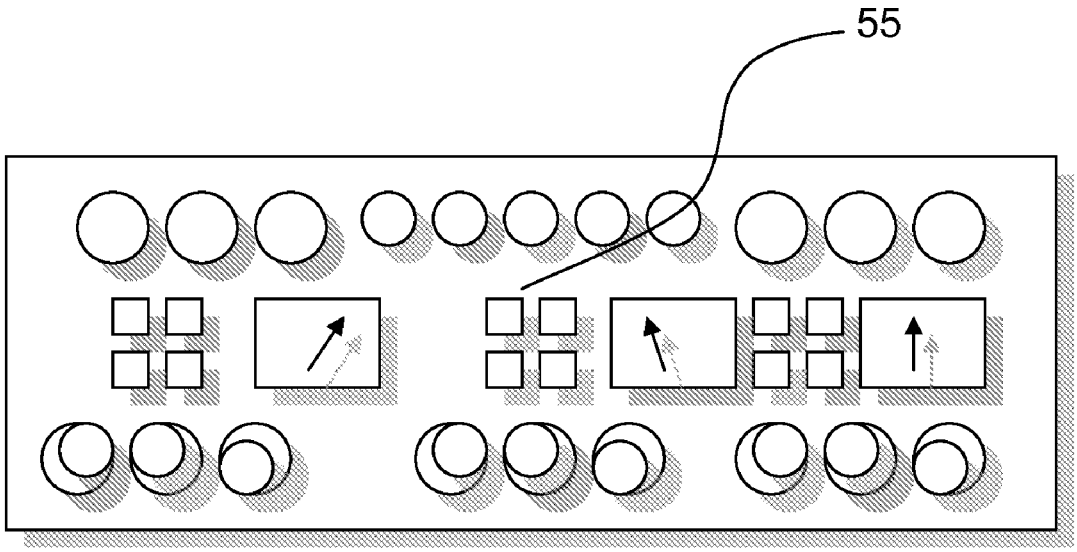
FIG. 2 illustrates one schematic embodiment of a control panel for the top-drive/drawworks system of the present invention.

The drawworks 12 and the top drive 13 are controlled in the Driller's cabin with joysticks and potentiometers 55, as shown in FIG. 2. The joysticks control the speed throttle, and the potentiometers control torque and the top drive 13. As set forth in FIG. 4, the motor 43 has encoder feedback for use with drill pipe.

The rig 10 has an automated block position program to prevent a collision with the crown 19 (top section of the mast 11) and the rig floor 20.

The Driller has excellent torque and speed control of the AC drive motors 41,42,43,44 when tripping or drilling. The VFD's 21,22,23,24 incorporate a closed loop vector control method internal to the drives. In other words, digital encoders are mounted on the shaft of the motors 41,42,43,44 to provide feedback to the VFD's 21,22,23,24 to maintain speed and positioning.

d) Automated Drilling System

Figure 3:
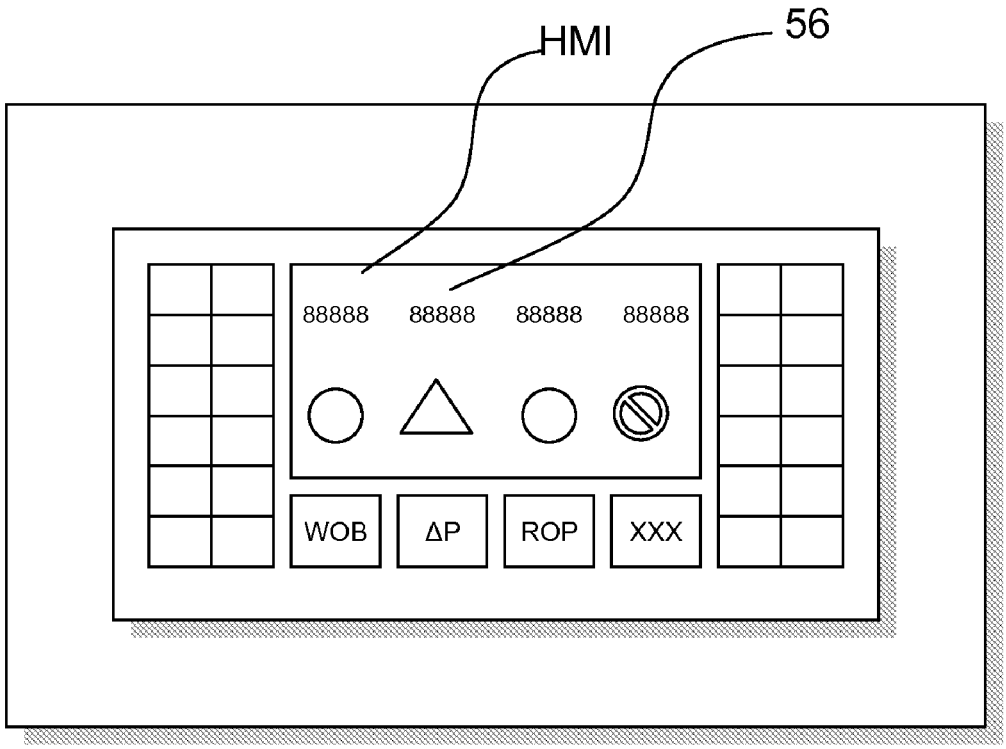
FIG. 3 illustrates one schematic embodiment of an auto-driller touchscreen set-up for the driller to enter desired program parameters and setpoints.

The automated drilling system used on the AC coil rig 10 utilizes closed loop control systems to control drilling with weight-on-bit (WOB), differential pressure (ΔP), and rate-of-penetration (ROP). The automated drilling system allows the Driller to input a set of drilling parameters via a touchscreen 56 (FIG. 3) to optimize drilling and tripping.

With reference to FIG. 4, the instrumentation system collects the drilling data from the PLC and processes it for display on the Driller's Control Console and touchscreen 56. The main process measurements collected are:

Mud Pressure;

Drawworks Hookload;

Injector Hookload; and

Rate-of-penetration (ROP).

The data collected from these three main components are conditioned and coordinated to output a speed command to the VFD's 21,22,23,24 that will produce the optimum rate-of-penetration (ROP) for the Driller. The VFD's 23,24 control the top drive and speed of the drawworks 12 when drilling with traditional drill pipe, and another set of VFD's 21,22 control the speed of the injector motors 41 and the storage reel motor 42 when drilling with coil tubing 14. At the mud pump 18, a pressure transmitter provides analog input to the PLC which represents mud pump pressure P.

The Driller inputs the desired setpoints into the Autodriller Screen:

differential pressure (ΔP);

weight-on-bit (WOB); and rate-of-penetration (ROP).

The drilling system utilizes PID control loops to control the speed commands to the drive motors (PID=Proportional Integral and Derivative control). There are three separate PID loops, one for the ΔP, WOB, and ROP, which are cascaded together to control the speed of the coil or drawworks drilling system. The driller initiates a start command for the Autodriller to take over and control the feed off rate or speed command to the Drives. When the driller wants to stop, he simply presses the Stop Autodrill Pushbutton.

i) PID: Concept

PID equation (set out earlier) controls the process by sending an output speed signal to the appropriate VFD 21,22,23, 24. The greater the error between the setpoint and process variable input, the greater the output signal, and vice versa. An additional value (feed forward or bias) can be added to the control output as an offset. The result of PID calculation (control variable) will drive the process variable being controlled toward the set point.

The Driller has several control limits that he can set to control the torque on the coil 14 and drill pipe. The coil process controls the chain tension, injector traction pressure, and the torque tension on the coil 14 between the reel 17 and the injector 15. Care has to be taken not to exceed the pressure or pull on the gooseneck 16. All these parameters are monitored by the drill system to drill safely within the design specifications of the Rig.

An important design feature of the AC Drive system was to incorporate a closed loop system on the Autodriller. An open loop type of control requires the Driller to manually control the Speed throttles and Torque Control potentiometers continuously while drilling.

e) Differences and Advantages of Applicant's CTR Over Conventional Coil Tube Rigs Some of the many advantages of the present invention may now be better understood.

Applicant's CTR 10 utilizes AC electric motors on mud pumps 18 (motor and VFD not detailed), drawworks 12 (motor 44 and VFD 34 not detailed), top drive 13, injector 15, and storage reel 16 which provide operational advantages, unlike conventional coil tube rigs which use less effective hydraulic motors to run the top drive, storage reel and injector, and a diesel motor on the mud pump and drawworks. Applicant is the first to successfully implement such features.

Applicant's Auto-Driller advantageously allows hands free automated control of drawworks 12, top drive 13, injector 15 and storage reel 17. Conventional rigs need constant Operator input to control drilling parameters. Adjustment of hydraulic pressures is necessary every time the hole dynamics change.

Applicant's PLC advantageously controls and monitors the output to the VFDs 21,22,23,24 which in turn control the electric motors 41,42,43,44 and thus adjusts the rate at which drilling occurs automatically. Conventional rigs need constant Operator input to adjust hydraulic pressures to change the feed rate of tubing.

At slow feed rates, Applicant's AC controlled injectors 15 have finer control as opposed to conventional hydraulic controlled injectors which have less desirable mechanical limitations.

Response times of conventional hydraulics are much slower than applicant's VFD controlled AC motors. Torque control is also tighter with VFD controlled AC motors.

Temperatures affect hydraulic performance of hydraulic driven components, i.e., injectors, top drives. Hydraulically driven top drives have limitations due to heat and mechanical losses. Applicant's invention largely avoids this problem.

Applicant's PLC control of motors and drilling operations allows for increased safety due to automated controls which decrease the potential for human error.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

The embodiments of the invention in which an exclusive property or privilege is claimed are defined as follows:

1. A method of automatic drilling a well comprising:

supporting a coil tube injector in a mast for injecting a string of coil tube with a drill bit from a reel and into a wellbore for drilling the wellbore;

placing the drill bit at a bottom of the wellbore;

determining a tare mud pressure;

setting a differential pressure;

measuring a drilling mud pressure while drilling;

establishing a differential pressure between the tare mud pressure and the measured drilling mud pressure for controlling a first variable frequency drive for controlling a first alternating current motor driving the injector for controlling a rate of injection of coil tube by the injector for maintaining the differential pressure; and controlling a second variable frequency drive for controlling a second alternating current motor driving the reel for maintaining a relative rate of coil tube supplied from the reel to the injector.

2. The method of claim 1 wherein the controlling of the first variable frequency drive and second variable frequency drive comprises providing a programmable logic controller for controlling the first variable frequency drive and second variable frequency drive.

3. The method of claim 2 further comprising:

receiving the mud pressure at the programmable logic controller for controlling the differential pressure

4. The method of claim 3 further comprising:

using a proportional/integral/derivative (PID) algorithm for receiving the measured mud pressure, and controlling the first variable frequency drive and second variable frequency drives for controlling the speed of the first alternating current motor and the second alternating current motor for maintaining the differential pressure.

5. The method of claim 1 further comprising:

supporting a top drive in the mast and raising and lowering the top drive with drawworks for drilling the wellbore with drill pipe tubing;

controlling a third variable frequency drive for controlling a third AC motor for driving the top drive for at least making and breaking drill pipe connections; and controlling a fourth variable frequency drive for controlling a fourth AC motor for driving the drawworks for maintaining the differential pressure.

6. A drilling rig comprising:

a reel for supplying coil tube with a drip bit;

a mud pump for providing drilling mud;

an injector supported in a mast for injecting the coil tube with the drill bit from the reel into a wellbore for drilling therewith;

a first alternating current motor and a first variable frequency drive for controlling the rate of injection of coil tube by the injector;

a second alternating current motor and a second variable frequency drive for controlling the rate of coil tube supplied from the reel;

a mud pressure transmitter at the mud pump for measuring mud pressure while drilling; and a programmable logic controller for controlling the first and second variable frequency drives;

wherein the programmable logic controller receives at least the rate of injection and controls the first variable frequency drive for maintaining differential pressure by:

determining a tare mud pressure;

setting the differential pressure;

measuring the drilling mud pressure while drilling using the mud pressure transmitter;

establishing the difference between the tare mud pressure and the measured drilling mud pressure for controlling the first variable frequency drive for maintaining the differential pressure; and the programmable logic controller receives at least the reel's speed of rotation and controls the second variable frequency drive for maintaining rate of coil tube supplied relative to the rate of injection.

7. The drilling rig of claim 6 further comprising:

a top drive supported in the mast, a drawworks for raising and lowering the top drive for drilling the wellbore with drill pipe;

a third variable frequency drive for controlling a third alternating current motor for driving the top drive for at least making and breaking drill pipe connections; and a fourth variable frequency drive for controlling a fourth alternating current motor for driving the drawworks for maintaining the differential pressure.

* * * * *